US008662320B2

(12) United States Patent
Csak

(10) Patent No.: US 8,662,320 B2
(45) Date of Patent: Mar. 4, 2014

(54) THEFT DETERRENT SYSTEM FOR PRODUCT DISPLAY DEVICE

(75) Inventor: Louis Csak, Old Greenwich, CT (US)

(73) Assignee: Mechtronics Corporation, Fishkill, NY (US)

( * ) Notice: Subject to any disclaimer, the term of this patent is extended or adjusted under 35 U.S.C. 154(b) by 0 days.

(21) Appl. No.: 13/575,695

(22) PCT Filed: Jan. 31, 2011

(86) PCT No.: PCT/US2011/023155

§ 371 (c)(1),
(2), (4) Date: Apr. 25, 2013

(87) PCT Pub. No.: WO2011/094676

PCT Pub. Date: Aug. 4, 2011

(65) Prior Publication Data

US 2013/0327733 A1 Dec. 12, 2013

Related U.S. Application Data

(60) Provisional application No. 61/299,529, filed on Jan. 29, 2010.

(51) Int. Cl.
*A47F 1/04* (2006.01)

(52) U.S. Cl.
USPC ..... 211/59.3

(58) Field of Classification Search
USPC ..... 211/51, 59.2, 59.3, 175, 184; 312/61, 312/71; 108/60, 61; 221/123, 124, 127
See application file for complete search history.

(56) References Cited

U.S. PATENT DOCUMENTS

| | | | | | |
|---|---|---|---|---|---|
| 4,771,898 | A * | 9/1988 | Howard et al. | 211/59.2 |
| 5,439,122 | A * | 8/1995 | Ramsay | 211/187 |
| 5,570,811 | A * | 11/1996 | Wittern et al. | 221/127 |
| 5,673,801 | A * | 10/1997 | Markson | 211/59.3 |
| 5,738,019 | A * | 4/1998 | Parker | 108/108 |
| 6,041,720 | A * | 3/2000 | Hardy | 108/60 |
| 7,150,365 | B2 * | 12/2006 | Hardy et al. | 211/189 |
| 7,299,934 | B2 * | 11/2007 | Hardy et al. | 211/59.2 |
| 2003/0136750 | A1 * | 7/2003 | Fujii et al. | 211/90.02 |
| 2003/0160012 | A1 * | 8/2003 | Kanouchi et al. | 211/59.2 |
| 2004/0182804 | A1 * | 9/2004 | Harper | 211/90.02 |
| 2006/0186064 | A1 * | 8/2006 | Merit et al. | 211/59.3 |
| 2008/0083769 | A1 * | 4/2008 | Yuyama et al. | 221/1 |
| 2008/0245811 | A1 * | 10/2008 | Colelli et al. | 221/90 |

* cited by examiner

*Primary Examiner* — Joshua Rodden
(74) *Attorney, Agent, or Firm* — MKG, LLC

(57) ABSTRACT

A product display includes a wall member and a support surface coupled to the wall. Merchandise is displayed on the surface. At least one security support arm is pivotally coupled to the support surface and rotates about an axis. A security bar is coupled to the security support arm and extends over at least a portion of the merchandise. A warning device is coupled to the security support arm and activates to provide a warning as the support arm and the security bar rotate between a plurality of positions. The positions provide a multi-stage notification including a first position where no warning is provided, a second position where a first stage warning is provided, and a third position where a second stage warning is provided.

16 Claims, 10 Drawing Sheets

THEFT DETERRENT SYSTEM FOR PRODUCT DISPLAY DEVICE

BACKGROUND OF THE INVENTION

1. Field of the Invention

This invention relates to merchandise and/or product display systems and, in particular, to a theft deterrent system for merchandise and/or product display systems.

2. Description of Related Art

A wide variety of systems exist for displaying merchandise in a retail environment. Some display systems are freestanding while others are mounted to a support structure such as a gondola, pegboard or the like. Common configurations for support structures feature a pair of vertical standards or support members, a wall member disposed between the standards, and a plurality of vertically spaced shelves mounted to the standards. The shelves are oriented to face aisles in the retail establishment that run on either side of the support structure such that merchandise is visible and accessible by consumers and retail personnel. Additional shelving or other display areas define caps at an end of the support structure providing visibility and access to even more merchandise.

In retail establishments such as, for example, supermarkets, drug stores, grocery stores, convenience stores and the like, merchandise is usually displayed for sale on shelving in one or more horizontally spaced, side-by-side rows or columns of merchandise arranged front to back on each of the shelves. Alternatively, the merchandise may be suspended individually from hooks attached directly to the vertical standards of the support structure or a peg board arrangement formed within the wall member of the support structure. Although the merchandise in such retail environments is accessible substantially only from the front (e.g., such that a forward-most item of merchandise in a column of merchandise is accessible), conventional shelves and peg board displays typically permitted free access to the space above the merchandise displayed on each shelf, or hanging on an entire hook. In this way, a person who wished to do so could quickly and easily remove a large number of articles at one time. For example, it is known for thieves to "sweep" a shelf or a hook with their hand or arm, collect the merchandise displayed thereon and place the merchandise in a purse, bag, coat or other container and quickly exit a store without drawing attention to themselves. Similarly, it is known for thieves to detach a hook or empty all the items suspended from the hook or shelf into a suitable container and remove the hook and/or merchandise from the store. In this way, a thief could steal several hundred dollars worth of merchandise with very little effort and without great risk of being detected.

There have been attempts at minimizing theft by partially blocking access to display shelves or hooks to prevent a mass removal of articles therefrom, while permitting removal of individual articles by a prospective consumer. For example, it is known to install a panel in front of each stocked shelf to block or limit access to a first article on the shelf. However, if the panel is securely fixed in place on the shelf, the panel also prevents or impedes restocking of the shelves. As such, a security system of this type may cost more in terms of time store personnel must spend when restocking than the system saves in terms of reducing theft. Alternatively, if the panel is easily removed, then the panel has little value as a security device. Other conventional efforts at theft prevention include use of dispensing cabinets which are restocked through a lockable door at the rear of the cabinet, while leaving a first item in a row of products exposed for prospective customer inspection and purchase. While providing some theft prevention measures, the locked dispensing cabinet arrangements are typically costly, are limited in terms of the range of sizes of merchandise that can be accommodated in one case, and require at least some special handling for restocking merchandise.

Accordingly, the inventors have recognized that a need exists for new and improved security and theft deterrent systems of merchandise and/or product display systems.

SUMMARY OF THE INVENTION

This invention relates to merchandise and/or product display systems and, in particular, to a theft deterrent system for merchandise and/or product display systems providing a multi-stage notification system which differentiates between accidental and deliberate attempts of theft. An optional embodiment relates to linking the notification system to security systems for a retail environment/establishment where the system is deployed over wired and/or wireless communication paths. In one embodiment, a communication path permits remote security monitoring.

This invention also relates to merchandise and/or product display systems and, in particular, to a theft deterrent system having a mechanism whereby the product is advanced manually via a push button, with or without a time delay system after the customer removes the first product in the display. The advance of the product may also be automated upon removal of first product displayed and preferably includes a time delay to prevent easy access to multiple items by a potential shoplifter.

Another embodiment of this invention relates to merchandise and/or product display systems having a mechanism used in conjunction with the theft deterrent system which is easily and quickly adaptable to accommodate narrow and wide product with an easily width adjustable column display arrangement. For example, partitions or dividers couple to a support surface to permit rows and/or columns of merchandise to be displayed. The dividers are selectively installable to accommodate merchandise of differing widths.

This invention, in another aspect, relates to merchandise and/or product display systems having pushers for advancing the merchandise after customer removal of a single item of merchandise. The pushers are adaptable to any weight of merchandise. Therefore, there is no need for "heavy" and "light" pushers for different products as is known in the art.

This invention, in another aspect, relates to merchandise and/or product display systems having a flexible membrane to prevent merchandise and/or product packaging containing the merchandise from slipping and/or tipping out of a desired upright position as the merchandise advances in the column of merchandise.

This invention, in another aspect, relates to merchandise and/or product display systems which despite having the theft prevention system in place, features easy restocking of merchandise by store personnel by including an extendable bracket on which a drawer or shelf containing the merchandise can slide out for bulk refill. In one embodiment, the sliding merchandise drawer or shelf includes a lock to prevent unauthorized extension of the drawer or shelf to access more merchandise displayed thereon.

An embodiment of the invention provides a theft deterrent product display device which includes a security bar selectively positioned, at rest, above a second item of merchandise in a column of merchandise to allow withdrawal of a first item of merchandise without contacting the security bar. The security bar is attached pivotally to the underlying shelf and has a theft notification system trigger by a switch or sensor coupled to the bar such that when the security bar is pushed back beyond, the switch or sensor detects the rotation and triggers a warning. A range of motion or rotation is accommodated to allow for a first accidental warning, for example, when a shopper accidentally pushes the security bar causing rotation and a second, possible theft warning when the shopper appear to intentionally push on the security bar causing rotation. The notification system may include security cameras, alarms, and/or electronic notification of store or remote security personnel if the extreme position is reached indicating a theft is, or may be, in progress.

BRIEF DESCRIPTION OF THE DRAWINGS

In these figures like structures are assigned like reference numerals, but may not be referenced in the description of all figures.

DETAILED DESCRIPTION OF PREFERRED EMBODIMENTS

Figure 1A:
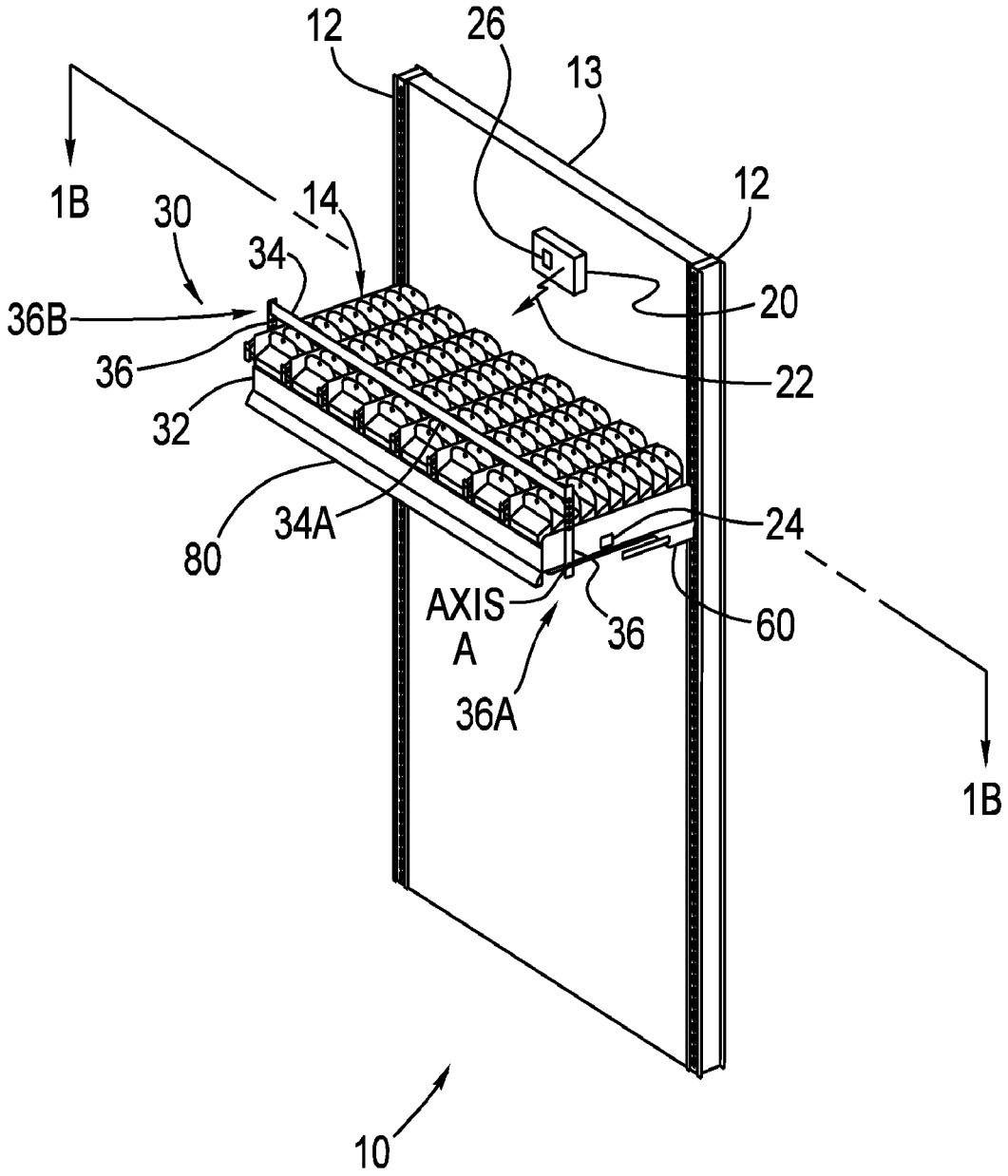
FIG. 1A is a perspective view of a merchandise and/or product display having a theft deterrent system according to one embodiment of the present invention.
Figure 1B:
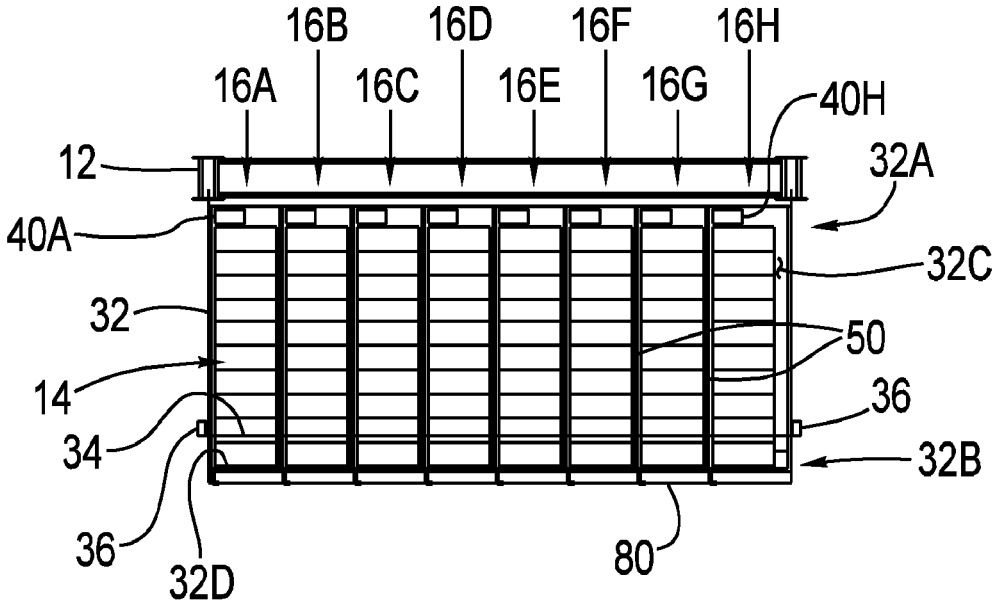
FIG. 1B is a top, plan view of the merchandise and/or product display and the theft deterrent system of FIG. 1A.

FIGS. 1A and 1B illustrate a merchandise and/or product display 10 having a theft deterrent system 30. In one embodiment, the merchandise display system 10 includes a pair of upright standards 12 and a wall member 13 disposed therebetween for displaying merchandise 14 to prospective customers for purchase within a retail environment. The theft deterrent system 30 includes a shelf, rack or other support surface 32 selectively coupled to the upright standards 12 by, for example, one or more brackets 60 (e.g., a pair of brackets shown). As shown in FIG. 1B, merchandise 14 is arranged front-to-back along an upper surface 32C the shelf 32 in a plurality of side-by-side columns 16, for example, columns 16A-16H shown. In one embodiment, the plurality of columns 16 are retained laterally by inboard surfaces of a plurality of divider walls 50, for example, adjacent divider walls 50 cooperates to bound each of the plurality of columns 16. In one embodiment, the divider walls 50 are selectively coupled to the shelf 32 such as, for example, by a protrusion or finger extending from the wall 50 into a mating groove or slot in the shelf 32. In one embodiment, the merchandise 14 in each of the plurality of columns 16 is driven in a forward direction from a rearward portion 32A of the shelf 32 to a forward portion 32B of the shelf 32 by a plurality of pusher elements 40 (e.g., pusher elements 40A-40H shown) disposed at a rear of each of the columns 16A-16H. It should be appreciated that the rearward portion 32A and forward portion 32B of the shelf 32 are viewed from the perspective of a consumer standing in front of the merchandise and/or product display 10. In one embodiment, a panel 80 is coupled to the forward portion 32B of the shelf 32 to retain the forward advance of the columns 16 of merchandise 14.

As shown in FIGS. 1A and 1B, in one embodiment the theft deterrent system 30 includes a security bar 34 and one or more security support arms 36 (e.g., a pair of security support arms are shown). In accordance with the present invention, the security support arms 36 are each pivotally coupled to the shelf 32, or the bracket 60 supporting the shelf 32, about a rotational axis A at a first end 36A of each arm 36 and coupled to the security bar 34 at a second end 36B of each arm. The security bar 34 includes a first or lower surface 34A disposed at a height above the shelf 32. As described in detail below, the security bar 34 and security support arms 36 rotate between a plurality of positions when a force is applied to the security bar 34 to activate a warning device 20, coupled to the merchandise display system 10, that provides a notification 22 of varying actions which may indicate a withdrawal or an attempt to withdraw the merchandise 14 from the merchandise and/or product display 10.

Figure 2:
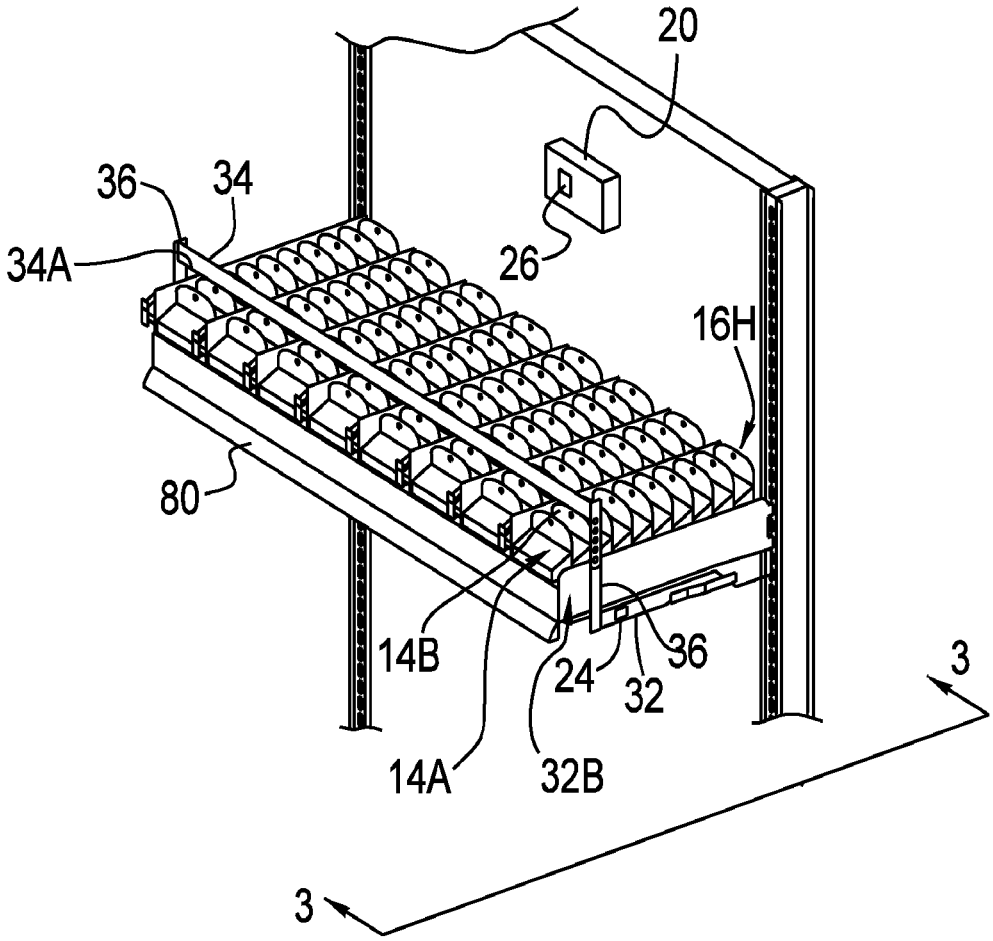
FIG. 2 is an enlarged perspective view of the merchandise and/or product display and the theft deterrent system of FIG. 1A.

As shown in FIG. 2, the security bar 34 extends between the respective pair of security support arms 36 and, as such, the security bar 34 traverses at least a portion of the forward portion 32B of the shelf 32 and the merchandise 14 displayed thereon. In one embodiment, one or both of the security bar 34 and/or the pair of security support arms 36 are adjustable with respect to one or both of a height that the security bar 34 (e.g., the first surface 34A) is above the upper surface 32C of the shelf 32 and a depth (e.g., inward position) that the security bar 34 (e.g., the first surface 34A) is from a front edge 32D of the forward portion 32B of the shelf 32. In one embodiment, where the panel 80 is coupled to the shelf 32, the front edge 32D of the shelf 32 is defined by an inboard surface of the panel 80. In one embodiment, the security bar 34 and/or security support arms 36 height and depth adjustment is such that the security bar 34 lies above an upper surface of a member 14B (e.g., a second member) of the merchandise 14 in each of the plurality of columns 16 of the merchandise 14. For example, and as is illustrated in FIGS. 2 and 3A-3C, the security bar 34 (e.g., the first surface 34A) is selectively positioned in terms of one or both of its height and depth on the shelf 32 such that a first member 14A of the merchandise 14 may be selected and removed from its position within one of the columns 16, e.g., the column 16H, of merchandise 14, without contacting the security bar 34, while removal of the second member 14B of merchandise 14 for the column 16 is at least partially obstructed or blocked by the security bar 34 such that removal of, or an attempt to remove, the second member 14B from the shelf 32 results in contact between the security bar 34 and the second member 14B. It should be appreciated that the placement (e.g., height and depth) of the security bar 34 and/or security support arms 36 may be adjusted to accommodate the merchandise 14 displayed on the shelf 32 including product and product packaging size and form, as well as features of the product and/or merchandise display system 10 and its components.

In one embodiment of the present invention, the product and/or merchandise display system 10 and the theft deterrent system 30 operate to provide a multi-stage notification or warning system as follows. In a first position, illustrated in FIG. 3A and labeled "Position 1", the security bar 34 (e.g., the first surface 34A) lies substantially directly above the upper surface of the member 14B of merchandise 14 of each of the columns 16 of merchandise 14. For example, in this Position 1, the first member 14A of merchandise 14 of each of the columns 16 of merchandise 14 is visible to and accessible by consumers. The first member 14A may be removed from, examined by the consumer and returned to the shelf 32 without engaging the security bar 34. However, the second member 14B is at least partially obstructed or blocked by the security bar 34 to inhibit or prevent withdrawal without contact. It should be appreciated that Position 1 depicts a stationary or ready position of the merchandise and/or product display 10 having the integrated theft deterrent system 30.

Figure 3A:
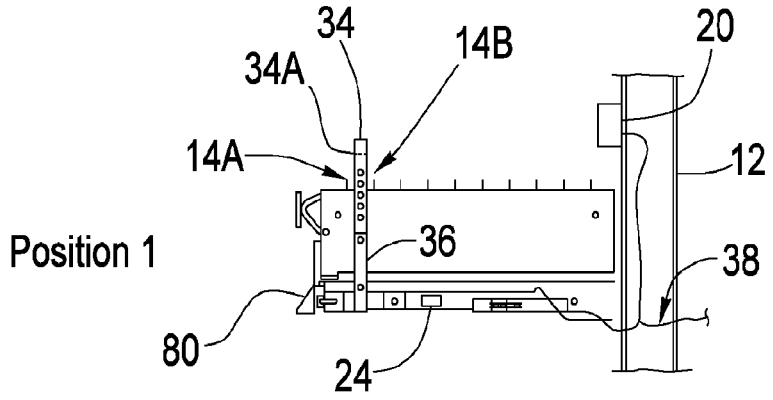
FIGS. 3A-3C depict various stages of operation and activation of the merchandise and/or product display and the theft deterrent system of FIGS. 1A and 2.
Figure 3B:
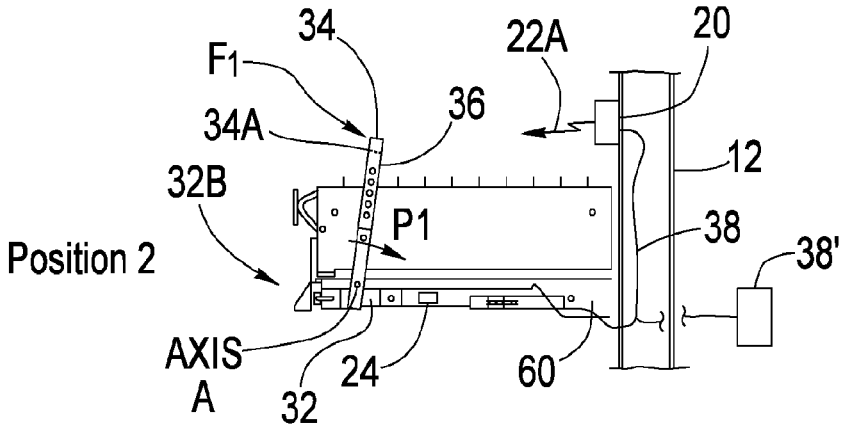

In a second position, illustrated in FIG. 3B and labeled "Position 2", a first force F1 is applied to at least one of the security bar 34 and support arms 36 by a consumer, store personnel and the like directly or through contact with the merchandise being moved, such that the security bar 34 and support arms 36 pivot about axis A in a direction illustrated by arrow P1 away from the forward portion 32B of the shelf 32 to expose at least a partial portion of the upper surface of the second member 14B of merchandise. While the portion of the upper surface of the second member 14B is partially exposed, the security bar 34 still substantially prevents withdrawal of the second member 14B of merchandise 14 from the shelf 32. It should be appreciated that Position 2 depicts the merchandise and/or product display 10 and the theft deterrent system 30 at a position indicating that the security bar 34 and/or support arms 36 may have accidentally been encounter to pivot or actuate the theft deterrent system 30. In one aspect of the invention, Position 2 and the assumed "accidental actuation" represents a first stage or level of notification of possible theft. In one embodiment, at the first stage of notification, the warning device 20 is activated to provide the warning or notification 22, e.g., a first stage warning 22A, to at least one of the prospective customers, store personnel and/or store security personnel on site or at a remote location. At the first stage of notification, the first stage warning 22A may include, for example, a flashing light or other visual output by the warning device 20, a short tone or other audio output by the warning device 20, or combination visual and audio output provided to at least one of the prospective customers, store personnel and/or store security personnel. In one embodiment, the first stage of notification the warning device 20 may produce the warning 22 (e.g., the first stage warning 22A) for a predetermined time period of, for example, about fifteen (15) to thirty (30) seconds. After the time period expires, the warning device 20 is automatically reset or deactivated.

Figure 3C:
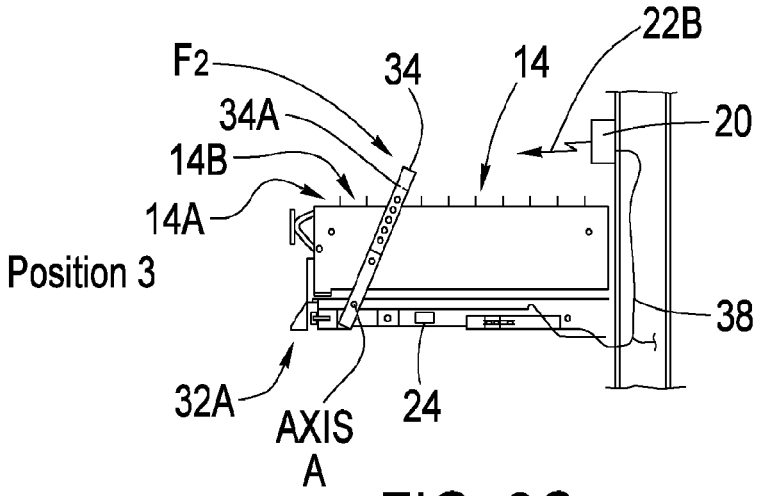

In a third position, illustrated in FIG. 3C and labeled "Position 3", a second force F2 is applied by a consumer, store personnel and the like, to at least one of the security bar 34 and support arms 36 (where force F2 is greater in magnitude than force F1). The force F2 is such that the security bar 34 and support arms 36 pivot, or continue to pivot if moving from Position 2, in the direction P1 away from the forward portion 32B of the shelf 32, to expose the entire upper surface of the member 14B (e.g., the second member) of merchandise 14. It should be appreciated that Position 3 depicts the merchandise and/or product display 10 and the theft deterrent system 30 at a position indicating that the security bar 34 or support arms 36 may have intentionally been encountered so as to remove a maximum number of merchandise 14 from the shelf 32 such as, for example, in a possible "sweeping operating" or other attempted theft. As shown in FIG. 3C, the theft deterrent system 30 is actuated as the security bar 34 and support arms 36 pivot away from the front 32B of the shelf 32. In one aspect of the invention, Position 3 and the assumed "sweeping" actuation represents a second stage or level of notification of possible theft. In one embodiment, at the second stage of notification, the warning device 20 is actuated to provide the warning 22, e.g., a second stage warning 22B, to at least one of the prospective customers, store personnel and/or store security personnel on site or at a remote location. At the second stage, the warning 22 (e.g., the second stage warning 22B) may include, for example, a continually flashing light or other visual output, a loud tone or other audio output, or a combination visual and audio signal provided to at least one of the prospective customers, store personnel and/or store security personnel. In one embodiment, as Position 3 assumes that a theft is in progress or being attempted, the second stage of notification continually provides the warning until the theft deterrent system 30 is reset by store personnel. In one embodiment, the visual, audio and/or combination warnings 22 between positions and stages may defer. For example, at the first stage the warning device 20 may illuminate the first stage warning 22A as a first color light or indicator (e.g., a yellow light) such as, for example, by a flashing, pulsing, blinking or continuous activation, while at the second stage, the warning device 20 may illuminate the second stage warning 22B as a second color light or indicator (e.g., a red light) by flashing, pulsing, blinking or continuous activation.

As described above, Position 1 reflects a ready operating state or mode of the merchandise display system 10 and the theft deterrent system 30 such that prospective customers may selectively retrieve the first member 14A of merchandise 14 from one of the plurality of columns 16 of merchandise 14 for review and/or purchase. Position 2 and Position 3, respectively, reflect varying attempts to retrieve more that one member of merchandise 14 from any one of the columns 16 of merchandise 14. For example, Position 2 may reflect an accidental actuation state or mode of the merchandise display system 10 and the theft deterrent system 30 such as when a customer inadvertently impacts the security bar 34 or support arms 36 while attempting to retrieve only the first member 14A of merchandise 14. Position 3, on the other hand, may reflect a deliberate attempt to sweep all the merchandise from one or more of the columns 16 of merchandise 14. It should be appreciated that while three stages, positions and/or modes of operation are discussed above with respect to the product and/or merchandise display system 10 and the theft deterrent system 30, it is within the scope of the present invention to employ one (e.g., lesser) and more (e.g., more than three stages) within the multi-stage notification and/or warning system as described herein. Moreover, one or more of the stages, positions and/or modes may be selectively activated or deactivated to suit a particular environment. For example, at one or more environments (e.g., retail environments), the warning device 20 may not activate the warning 22 when the security bar 34 and/or the security support arms 36 are encountered and driven into position 2.

As shown in FIG. 3A, it is contemplated that the security bar 34 and/or security support arms 36 are coupled to, for example, a switch or sensor 24, e.g., a motion sensor such that pivoting or rotational movement triggers a signal output 38 that actuates the warning device 20 to inform customers, store personnel and/or security personnel of movement within the various stages, positions or modes. In one embodiment, the signal output 38 is electrically coupled to the warning device 20 and/or a computer network 38' such as, for example, an intranet, extranet or the Internet, directly or indirectly over wired and/or wireless communication paths for detecting and monitoring of the various positions of the theft deterrent system 30 either in the retail environment/establishment where the system 30 is deployed or at a remote, off-site location. In one embodiment, the signal output 38 and/or the warning device 20 may actuate a still or video security camera 26 to record activity at the merchandise display system 10 upon receiving at least one of the first stage notification (assumed accidental contact) and/or the second stage notification (assumed active contact as in a probable theft).

It should also be appreciated that a resting stage or, as described above as the ready operating stage, of the security bar 34 and security support arms 36 is Position 1. It is within the scope of the present invention to provide biasing means such as, for example, a spring or the like, to return the security bar 34 and the security support arms 36 from either or both of Position 2 and Position 3, back to its ready state at Position 1.

Figure 4A:
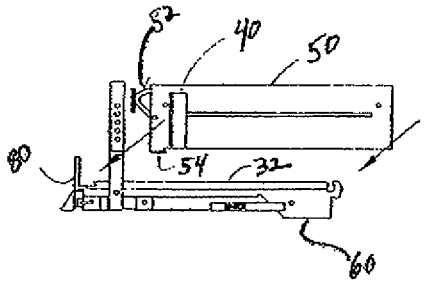
FIGS. 4A-4C illustrate exemplary features of the merchandise and/or product display and theft deterrent system according to embodiments of the present invention.
Figure 4B:
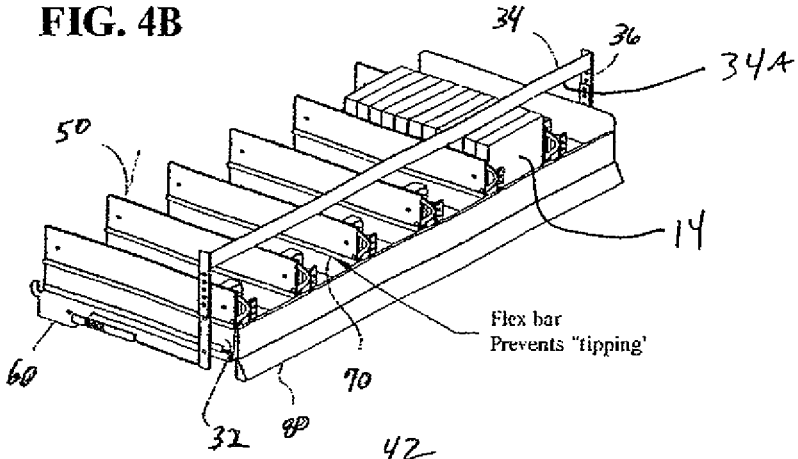
Figure 4C:
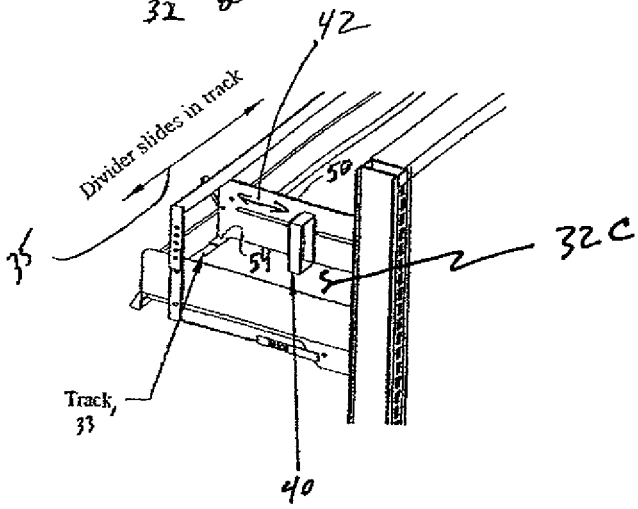

In one embodiment, each of the pusher elements 40 is coupled to a base 42 and the base 42 traverses a slot in or other path on the shelf 32. A known spring-biased pusher element and base arrangement is disclosed in commonly owned U.S. patent application Ser. No. 11/835,043, the disclosure of which is incorporated by reference herein in its entirety. As shown in this U.S. patent document, in one embodiment, the pusher 40 includes rotating paddle to accommodate relatively narrow and wide products with an adjustable pusher element 40. In another embodiment, illustrated in FIGS. 4A-4C, each of the pusher elements 40 is coupled to an associated one of the divider walls 50. The pusher elements 40 advance merchandise 14 manually or in an automated fashion. In the embodiment of FIGS. 4A-4C, a button or lever 52 is depressed to move the pusher element 40 in a direction toward the forward portion 32B of the shelf 32. In one embodiment, movement of the pusher element in response to depression of the button 52 is achieved through a conventional linear drive motion arrangement including, for example, a gear track mounted within the divider wall 50, a pinion gear mounted to the pusher element 40 and a motor driving the pinion gear. When the button is depressed, the motor is actuated to drive the pinion gear to move the pusher element 40 in the direction toward the forward portion 32B of the shelf 32. In one embodiment, in response to each button press, the pusher element 40 advances merchandise by a predetermined distance such as, for example, a distance corresponding to a depth (measured from front to back) of one item of merchandise 14 in a column 16. As such, each depression of the button 52 advances a respective column of merchandise in a stepwise manner, where each step equates to filling a void in the column left when one item of merchandise is removed from the column. Conventional linear motion arrangements of this type may be purchased from manufacturers of product drive systems such as, for example, Stock Drive Products/Sterling Instruments (SDP/SI), New Hyde Park, N.Y. (USA) or PIC Designs, Middlebury, Conn. (USA). In one embodiment, the pusher element 40 and linear motion arrangement are suitable for advancing relatively "heavy" and "light" merchandise, as is known in the art.

As noted above, the pusher element 40 advances product in either a manual, stepwise manner (e.g., button actuates linear drive arrangement) and in an automated manner. In the automated advancement, the pusher element 40 is coupled to a carriage (not shown). The carriage is slidably mounted on one or more rails (not shown) mounted parallel to and extending at least the width of the divider wall 50. In one embodiment, the carriage and one or more rails are disposed within an interior chamber of the divider wall 50. The rails allow the carriage and thus, the pusher element 40, to reciprocatingly traverse the rails in direction of double-headed arrow 42, e.g., from and between the rear portion 32A and the forward portion 32B of the shelf 32 (FIG. 4C). In one embodiment, the carriage and pusher element 40 traverse the rails by means of, for example, a belt and pulley assembly (not shown). Alternatively, the carriage may be driven by a motor (not shown) connected to the carriage and engaging at least one of rails. In yet another embodiment, the carriage rides upon a pinion gear (driven by the motor) and a gear track such as is described above in the aforementioned linear motion arrangement. Such a reciprocating carriage arrangement is similar to printhead carriage arrangements found in, for example, inkjet type desktop printer units as are known in the art.

It should be appreciated that, in one embodiment, both the manual stepwise advancement and automated reciprocating advancement of the pusher element 40 may include an immediate response to an actuation request (e.g., depression of the button 52) or a delayed response to the actuation request for a predetermined time period. The delayed response feature is seen to provide a further method of preventing, or at least slowing down, a potential theft as product replacement in the column (e.g., product feed) is not immediate. However, as can be appreciated, the duration of the delay period is typically arrived at by, for example, balancing the desire to slow a potential theft as well as the desire not to have prospective consumers frustrated by what is perceived as too long a period of time to retrieve a second item of merchandise within a column of merchandise. It should also be appreciated that at least one perceived advantage of the automated reciprocating advancement of merchandise is seen to be that product advancement, as described herein, is now controllable by, for example, a computer program control or like routine. This programmability is seen to provide great flexibility to display system designers as they continue to develop systems to efficiently serve the public while mitigating fraud and theft.

As shown in FIGS. 4A-4C, the divider wall 50 is removably installable on the shelf 32 and extends substantially from the rear portion 32A of the shelf 32 to the forward portion 32B of the shelf 32. The plurality of the divider walls 50 are coupled to the shelf 32 and cooperate with the shelf 32 to bound the plurality of columns 16. In one embodiment, described above, the panel 80 is coupled to the forward portion 32B of the shelf to bound forward extremities of each of the columns 16. As shown in FIG. 4C, in one embodiment, the forward portion 32B of the shelf 32 includes a recess or track 33. The track 33 receives a leg portion 54 of the divider wall 50. The leg portion 54 extends vertically downwardly and at least one of rightward or leftward from the divider wall 50. The leg portion 54 of the divider wall 50 and the track 33 cooperate such that one or more of the plurality of divider walls 50 may be selectively adjusted horizontally (e.g., in directions indicated by double arrow 35) to selectively define a width of one or more of the columns 16. It should be appreciated that the positions of divider walls 50 relative to the shelf 32 may be adjusted horizontally about the surface 32C of the shelf 32 such that each of the columns 16 are of a same width, two or more different widths, and any combinations thereof. Once a suitable arrangement of column widths are defined, the divider walls 50 may be snapped in or otherwise fixedly coupled to (e.g., locked in place on) the shelf 32. In one embodiment, a flex bar 70 is coupled to one or more of the plurality of divider walls 50. In one embodiment, the flex bar 70 is comprised of a flexible membrane such as, for example, a cellular foam or soft solid sheet or an elongated extrusion of a polymeric elastomer, selected from the group including thermoplastic and thermosetting elastomers, including but not limited to, polyethylene, polypropylene, polyvinylchloride, polyester, polyurethane, polycarbonate, polyetherimide, polysulfone, polystyrene, acrylonitrile-butadiene-styrene block copolymer, Teflon, fluoropolymers, acetal polymers, polyvinyl chloride, nylon and combinations thereof and blends thereof. Thermosetting rubbers such as natural rubber, SBR, NBR, silicone rubbers, and acrylic rubbers are also useful. The flex bar 70 substantially holds the merchandise 14 (or product packaging containing the merchandise 14) in a substantially upright orientation by providing resistance to slippage provided as the products traverse the columns 16. For example, the flex bar 70 keeps the merchandise 14 in a proper orientation for display and protection by the security bar 34 and security support arms 36 of the present invention. As shown in FIG. 4B, in one embodiment, the flex bar 70 is mounted to a side surface of the divider wall 50 and preferably, on the side surface opposite from where the pusher element 40, if any, is coupled to each of the divider walls 50.

Figure 5A:
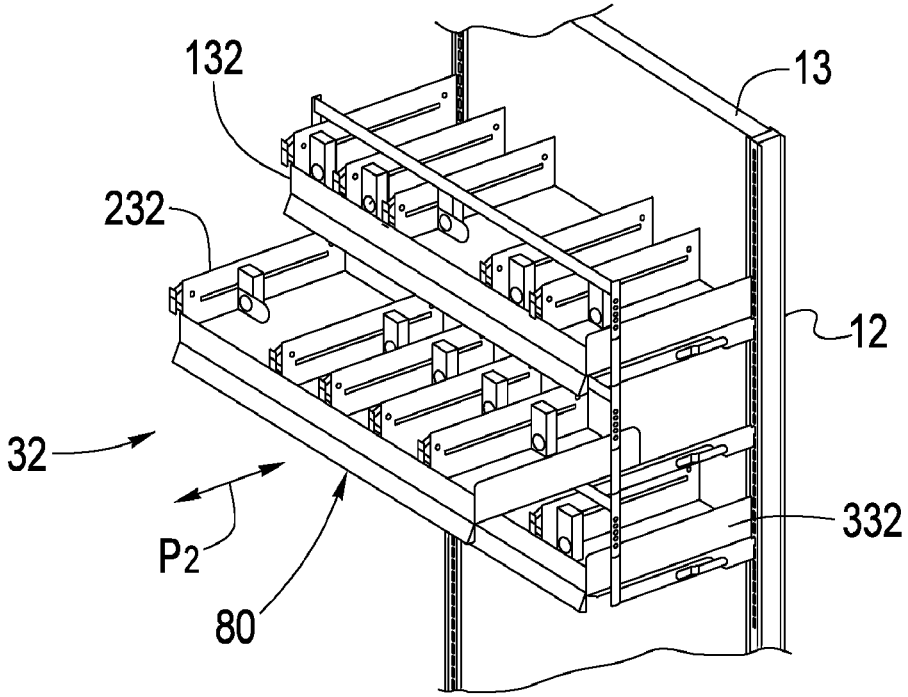
FIGS. 5A and 5B depict one embodiment of the merchandise and/or product display and theft deterrent system including a plurality of shelves, according to one aspect of the invention.
Figure 5B:
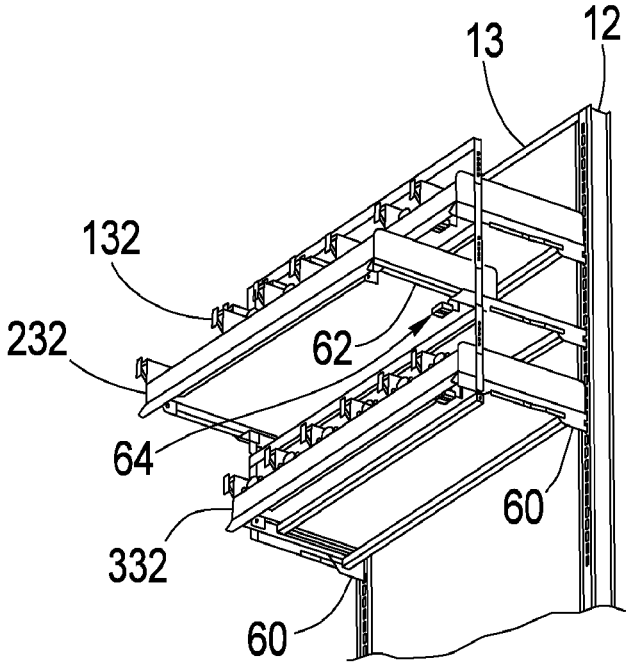

As described above, one or more support brackets 60 couple the shelf 32 to the vertical standards 12 of the merchandise display 10. In one embodiment, illustrated in FIGS. 5A and 5B, the brackets 60 include roller elements and a compound arm 62 such that an individual shelf 32 may be released and selectively extended (e.g., pulled away) from the gondola uprights 12 and wall 13 in a direction indicated by arrow P2. For example, in FIG. 5A, a plurality of the shelves 32 include shelves 132, 232 and 332 that are coupled to the product and/or merchandise display system 10. As shown in FIG. 5A, the shelf 232 is released and pulled forward of the display system 10 such that the columns 16 of the shelf 232 are more readily accessible and permit a bulk restocking of merchandise 14 on the shelf 232 while the remaining shelves 132 and 332 remain in proximity to the wall member 13. As shown in FIG. 5B, a latch mechanism 64 cooperates with the compound arm 62 to allow selective release and extension of the shelves 132, 232 and 332. In one embodiment, the latch mechanism 64 includes a manual lock (e.g., a pad lock) or an automatic lock (e.g., a magnetically actuated lock) to substantially prevent unauthorized access to the shelves 32.

Figure 6:
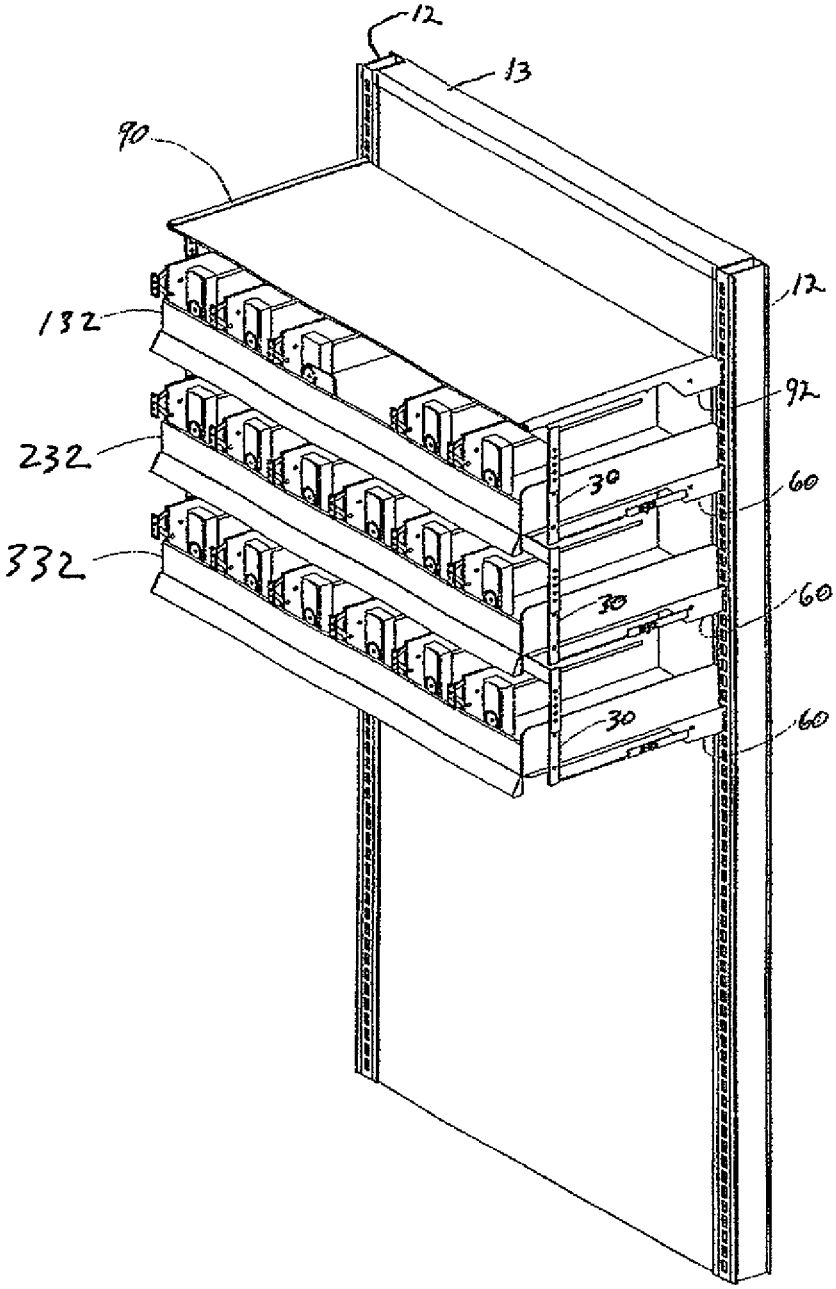
FIG. 6 is a perspective view of the merchandise and/or product display and theft deterrent system according to one embodiment of the present invention.

In one embodiment, illustrated in FIG. 6, to even further mitigate a potential for theft, a top cover plate or shelf 90 is coupled to the merchandise display system 10 by, for example, one or more brackets 92, above a top most shelf 32 that contains merchandise 14. For example, FIG. 6 depicts the shelves 132, 232 and 332 coupled to the merchandise display system 10. The top cover plate 90 is coupled to the display system 10 above the shelf 132. While shelf 132 is shown for clarity as not including merchandise 14, one skilled in the art should appreciate that the merchandise 14 is disposed in the upper shelf 132 such that the merchandise 14 would be accessible by merely reaching around or above the theft deterrent system 30 and withdrawing the merchandise 14 by lifting it vertically out of one or more of the columns 16 and off the shelf 132. The top cover plate 90 substantially eliminates this perceived threat by eliminating an ability to reach around or above the theft deterrent system 30 and withdraw merchandise in this way.

Figure 7:
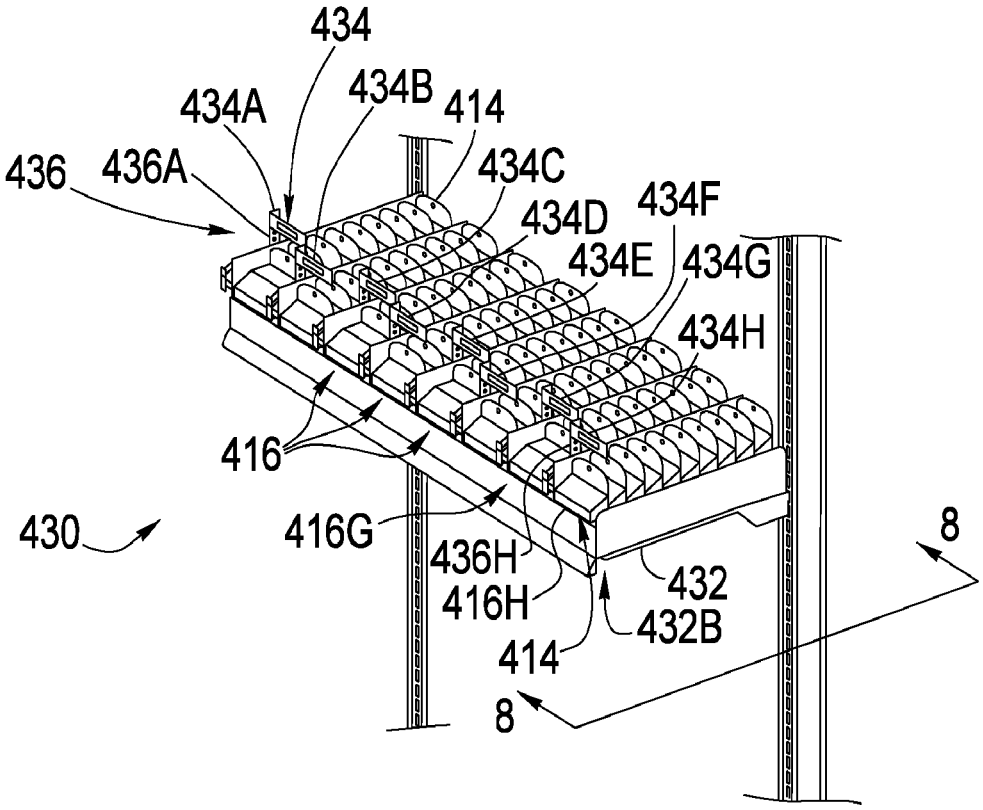
FIG. 7 is an enlarged perspective view of a merchandise and/or product display and a theft deterrent system according to one embodiment of the present invention.
Figure 8A:
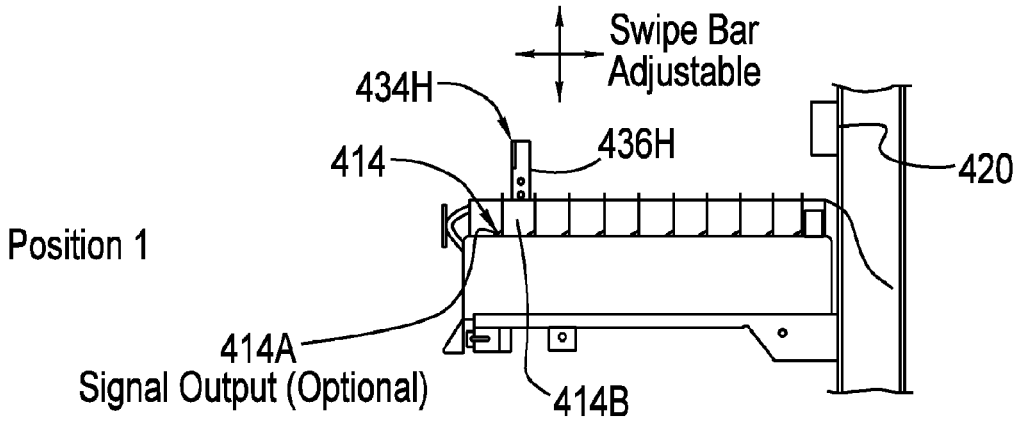
FIGS. 8A-8C depict various stages of operation and activation of the merchandise and/or product display and the theft deterrent system of FIG. 7.
Figure 8B:
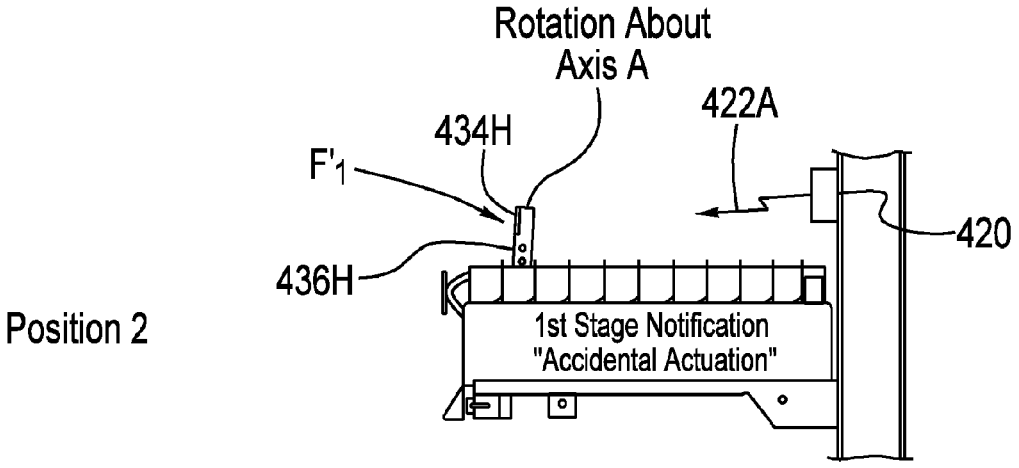
Figure 8C:
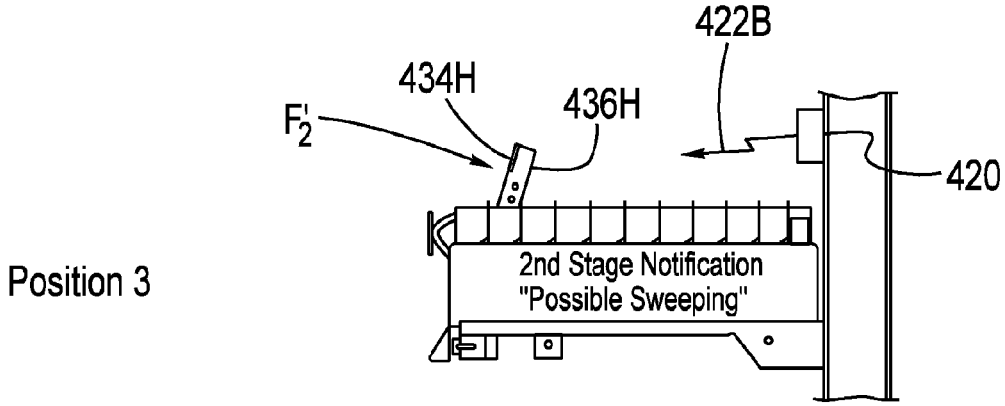

In another aspect of the present invention, a theft deterrent system 430 of the merchandise and/or product display 10 is shown in FIG. 7. In this embodiment, the theft deterrent system 430 includes a plurality of individual security bars 434, for example, security bars 434A, 434B, 434C, 434D, 434E, 434F, 434G and 434H are shown. Each of the plurality of security bars 434 protects merchandise 414 in of a respective one of the columns 416 of merchandise 414. Each of the security bars 434 is coupled to an associated security support arm 436. For example, security support arm 436A supports the security bar 434A. While not number consecutively within FIG. 7 for clarity purposes, it should be appreciated that security support arms 436B through 436H support the security bars 436B through 434H, respectively. In accordance with the present invention, each of the security support arms 436A-436H are pivotally coupled to the shelf 432, or a bracket supporting the shelf 432, and rotate about an axis A, as partially shown in FIGS. 8A, 8B and 8C, showing a side view taken in the plane 8-8 of FIG. 7. FIGS. 8A-8C illustrate the operation of the individual security bars 434 and security support arms 436, e.g., by showing the phases of operation of security bar 434H and security support arm 436H. Reference is made to the full explanation of Positions 1-3 and operation of security bars 34 and security support arms 36 depicted in FIGS. 3A, 3B and 3C, as substantially the same operations are accomplished by the individual security bars 434 and security support arms 436 of FIGS. 8A, 8B and 8C. That is, each of the security support arms 436A-436H pivot about its attachment point (e.g., axis A) to provide the aforementioned multi-mode notification or warning system. However, in the multiple individual security bar 434 and security support arm 436 configuration of FIGS. 8A-8C, the attachment point is a simple pivot point for each of the security support arms (e.g., arms 436A-436H) associated with each individual security bars (e.g., bars 434A-434H), providing for an ability to selectively adjust a height and depth of the of the security bar 434 and security support arm 436 configuration in a column by column basis. As with the description provided above for FIGS. 3A-3C, the security bar 434H and support arm 436H rotate between a plurality of positions (Positions 1-3) shown in FIGS. 8A-8C when a force (F1' or F2') is applied to the security bar 434H to provide notification of varying acts of withdrawing merchandise from the merchandise and/or product display 10.

As shown in FIG. 8A, the security bar 434H extends from its respective security support arm 436H and, as such, the security bar 434H traverses at least a portion of a forward portion 432B of the shelf 432 sufficiently to over lay and protect its respective column 416 of merchandise 414. In one embodiment, the security bar 434H and the security support arm 436H are adjustable with respect to a height that the security bar 434*h* is placed above an upper surface of the shelf 432 and with respect to a depth that the security bar 434H is placed in relation to a front edge of the forward portion 432B of the shelf 432. Preferably, the security bar 434H height and depth adjustment is such that the security bar 434H lies above an upper surface of a member 414B (e.g., a second member) of merchandise 414 in each of the columns 416A-416H of merchandise 414. In one embodiment, the security bars 434H and 434G, by way of example, are selectively adjusted to at least one of a different height or depth to reflect the difference in the merchandise in columns 416H and 416G. As shown in FIG. 7, the security bar 434G and the security support arm 436G in column 416G are positioned at a greater depth than the security bar 434H and the security support arm 436H in column 416H, and it is an advantageous feature that the security bars 434A-434H are selectively adjustable both in height off of the shelf 432 as well as in depth along columns 416 to account for differing package sizes in adjacent columns, as is shown in columns 416H and 416G.

In these ways, the present invention allows products to be quickly displayed in a user-friendly manner without the need to carefully scrutinize the collection of information in the standard rectangular product information region. The retailer can therefore delegate the tasks of assembling, re-arranging and replenishing such displays to personnel with a minimum of training and no specialized tools.

The terms "first," "second," and the like, herein do not denote any order, quantity, or importance, but rather are used to distinguish one element from another. In addition, the terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure, that numerous variations and alterations to the disclosed embodiments will fall within the spirit and scope of this invention and of the appended claims.

What is claimed is:

1. A product display, comprising:

a wall member;

a support surface having a rearward portion, a forward portion and an upper surface, the support surface is coupled to the wall member;

a plurality of merchandise displayed on the support surface, the plurality of merchandise including at least a first subset of merchandise and a second subset of merchandise;

at least one security support arm having a first end and a second end, the at least one security support arm is pivotally coupled to the support surface at the first end and rotates about an axis;

a security bar having a first surface, the security bar is coupled to the second end of the at least one security support arm such that the first surface extends over at least a portion of the plurality of merchandise displayed on the support surface and where an attempt to remove the at least a portion of the plurality of merchandise from the support surface results in contact with at least a portion of the first surface; and a warning device coupled to the at least one security support arm, the warning device is operable within a plurality of stages and is activated upon rotation of the at least one security support arm and the security bar by the contact between the at least a portion of the plurality of merchandise and the at least a portion of the first surface to provide a warning as the security support arm and the security bar rotate between a plurality of positions including:

a first position where the first subset of merchandise is unobstructed by the security bar, the second subset of merchandise is obstructed by the at least a portion of the first surface of the security bar, no contact is made to the security bar and no warning is provided, a second position where the first subset of merchandise is unobstructed by the security bar, the second subset of merchandise is partially obstructed by the at least a portion of the first surface of the security bar, contact is made to the security bar and a first stage warning is provided, and a third position where the first subset and the second subset of merchandise are unobstructed by the security bar, contact is made to the security bar and a second stage warning is provided.

2. The product display of claim 1, wherein each of the warnings is provided to at least one of a prospective customer, personnel operating a retail establishment employing the product display and security personnel for the retail establishment.

3. The product display of claim 2, further including a computer network coupled to the warning device such that each of the warnings is received in at least one of the retail establishment and a site remote from the retail establishment.

4. The product display of claim 1, wherein at least one of the security bar and the at least one security support arm adjusts in at least one of a height above the upper surface of the support surface and a depth from the forward portion of the support surface.

5. The product display of claim 1, wherein the plurality of merchandise is displayed in a plurality of side-by-side columns arranged from the forward portion to the rearward portion of the support surface.

6. The product display of claim 5, wherein the plurality of columns of merchandise each include at least a first member as the first subset and a second member as the second subset of the merchandise.

7. The product display of claim 5, further including a plurality of pusher elements disposed at a rear of each of the plurality of side-by-side columns to advance the merchandise in the columns from the rearward portion to the forward portion of the support surface in at least one of a manual and an automated fashion.

8. The product display of claim 6, wherein when in the first position, the first surface of the security bar lies substantially directly above the second member of merchandise of at least one of the columns such that the first member of the merchandise is visible and accessible for removal from the support surface while the second member is at least partially obstructed by the first surface of the security bar.

9. The product display of claim 1, wherein when a force is applied to at least one of the security bar and the at least one security support arm, the at least one security support arm rotates in a direction away from the forward portion of the support surface to enter the second position, the rotation activates the warning device to provide the first stage warning.

10. The product display of claim 1, wherein when a force is applied to at least one of the security bar and the at least one security support arm, the at least one security support arm rotates in a direction away from the forward portion of the support surface to enter the third position, the rotation activates the warning device to provide the second stage warning.

11. The product display of claim 1, wherein the first stage warning is comprised of one of a flashing light or other visual output by the warning device, a short tone or other audio output by the warning device, and combination visual and audio output by the warning device.

12. The product display of claim 1, wherein the second stage warning is comprised of a continually flashing light or other visual output by the warning device, a loud tone or other audio output by the warning device, and a combination visual and audio signal provided output by the warning device.

13. The product display of claim 1, further including biasing means coupled to the at least one security support arm to urge the security bar and the at least one security support arm from at least one of the second position and the third position back to the first position.

14. The product display of claim 1, wherein the plurality of merchandise is displayed in a plurality of side-by-side columns arranged from the forward portion to the rearward portion of the support surface, and the at least one security support arm is comprised of two security support arms coupled to opposite sides of the support surface and the security bar extends between the two security support arms.

15. The product display of claim 1, wherein the plurality of merchandise is displayed in a plurality of side-by-side columns arranged from the forward portion to the rearward portion of the support surface, and the at least one security support arm is comprised of one security support arm coupled to the support surface in proximity to each of the plurality of side-by-side columns such that the security bar extends from one of the security support arms over a portion of one of the plurality of columns.

16. The product display of claim 1, wherein the warning device further includes a security camera to record activity when providing each of the warnings.

* * * * *